US009574575B2

(12) United States Patent
Graves et al.

(10) Patent No.: US 9,574,575 B2
(45) Date of Patent: Feb. 21, 2017

(54) MULTI-PASSAGE DIFFUSER WITH REACTIVATED BOUNDARY LAYER

(71) Applicant: Rolls-Royce Corporation, Indianapolis, IN (US)

(72) Inventors: Charles B. Graves, Avon, IN (US); Stuart M. Bloom, Indianapolis, IN (US); Donald M. Wicksall, New Palestine, IN (US); Jacob E. Determan, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 384 days.

(21) Appl. No.: 14/105,572

(22) Filed: Dec. 13, 2013

(65) Prior Publication Data

US 2014/0260289 A1 Sep. 18, 2014

Related U.S. Application Data

(60) Provisional application No. 61/785,622, filed on Mar. 14, 2013.

(51) Int. Cl.

| | |
|---|---|
| ***F23R 3/04*** | (2006.01) |
| ***F04D 29/54*** | (2006.01) |
| ***F04D 29/44*** | (2006.01) |
| ***F04D 29/68*** | (2006.01) |

(52) U.S. Cl.

CPC ..... *F04D 29/547* (2013.01); *F04D 29/44* (2013.01); *F04D 29/54* (2013.01); *F04D 29/681* (2013.01); *F23R 3/04* (2013.01)

(58) Field of Classification Search

CPC ..... F04D 29/44; F04D 29/54; F04D 29/547; F04D 29/681; F23R 3/04

USPC ..... 60/751; 415/211.2, 224.5

See application file for complete search history.

(56) References Cited

U.S. PATENT DOCUMENTS

| | | | | |
|---|---|---|---|---|
| 2,709,337 | A | 5/1955 | Markowski | |
| 3,879,939 | A | 4/1975 | Markowski | |
| 4,098,074 | A * | 7/1978 | Greenberg | F04D 29/542 60/751 |
| 4,373,327 | A | 2/1983 | Adkins | |
| 4,796,429 | A | 1/1989 | Verdouw | |

(Continued)

FOREIGN PATENT DOCUMENTS

| | | |
|---|---|---|
| EP | 0628728 A1 | 12/1994 |
| EP | 0789195 A1 | 8/1997 |
| GB | 2390890 A | 1/2004 |

OTHER PUBLICATIONS

International Search Report PCT/US2013/072100 mailed on Jul. 8, 2014.

*Primary Examiner* — Steven Sutherland

(74) *Attorney, Agent, or Firm* — Fishman Stewart PLLC

(57) ABSTRACT

A diffuser is disclosed that includes a splitter having a blunt forebody useful in re-starting a boundary layer. The blunt forebody can be used to create a static pressure bow wave and interaction with a passing fluid stream that reduces a thickness of boundary layer formed on an opposing wall. The re-start in boundary layer can be used in a way that allows an upstream portion of the diffuser to be sized approaching a separation limit and a downstream portion of the diffuser to also be sized approaching a separation limit. In some forms the passages split by the blunt forebody can be sized relative to each other to balance flow between the branches.

20 Claims, 5 Drawing Sheets

(56) References Cited

U.S. PATENT DOCUMENTS

| | | | | |
|---|---|---|---|---|
| 5,077,967 | A | 1/1992 | Widener et al. | |
| 5,211,003 | A * | 5/1993 | Samuel | F01D 9/065 60/751 |
| 5,249,921 | A * | 10/1993 | Stueber | F04D 29/542 415/138 |
| 5,335,501 | A | 8/1994 | Taylor | |
| 5,592,821 | A * | 1/1997 | Alary | F04D 29/542 415/208.1 |
| 5,619,855 | A | 4/1997 | Burrus | |
| 5,737,915 | A | 4/1998 | Lin et al. | |
| 6,651,439 | B2 | 11/2003 | Al-Roub et al. | |
| 6,843,059 | B2 | 1/2005 | Burrus et al. | |
| 7,062,918 | B2 | 6/2006 | Walker et al. | |
| 7,080,516 | B2 | 7/2006 | Pidcock et al. | |
| 7,181,914 | B2 | 2/2007 | Pidcock et al. | |
| 7,707,834 | B2 | 5/2010 | Cayre et al. | |
| 7,895,840 | B2 | 3/2011 | Haller | |
| 2004/0118102 | A1 | 6/2004 | Child | |
| 2009/0272120 | A1 | 11/2009 | Tiemann et al. | |

* cited by examiner

MULTI-PASSAGE DIFFUSER WITH REACTIVATED BOUNDARY LAYER

CROSS-REFERENCE TO RELATED APPLICATIONS

This application claims priority to U.S. Provisional Patent Application No. 61/785,622 filed Mar. 14, 2013, the contents of which are hereby incorporated in their entirety.

GOVERNMENT RIGHTS

This disclosure was made with government support under N00019-04-C-0093 awarded by the United States Navy. The government has certain rights in the disclosure.

TECHNICAL FIELD

The present disclosure generally relates to diffusion of compressed air, and more particularly, but not exclusively, to multi-passage diffusers.

BACKGROUND

Providing diffusers that are relatively compact and/or can be made from a variety of manufacturing processes remain an area of interest. Some existing systems have various shortcomings relative to certain applications. Accordingly, there remains a need for further contributions in this area of technology.

SUMMARY

One embodiment of the present disclosure is a unique compressor diffuser. Other embodiments include apparatuses, systems, devices, hardware, methods, and combinations for diffusing air flow from a compressor of a gas turbine engine. Further embodiments, forms, features, aspects, benefits, and advantages of the present application shall become apparent from the description and figures provided herewith.

DETAILED DESCRIPTION

Figure 1:
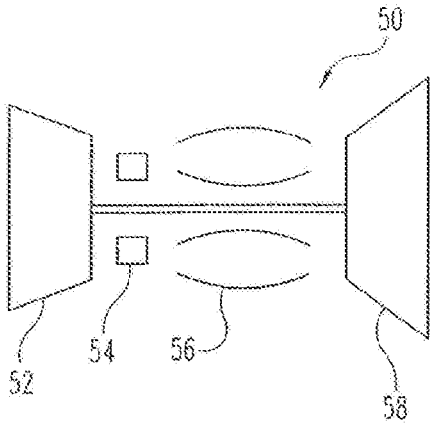
FIG. 1 depicts one embodiment of a gas turbine engine.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended. Any alterations and further modifications in the described embodiments, and any further applications of the principles of the disclosure as described herein are contemplated as would normally occur to one skilled in the art to which the disclosure relates.

With reference to FIG. 1, a gas turbine engine 50 is depicted and includes a compressor 52, diffuser 54, combustor 56, and turbine 58. The compressor 52 includes rotating turbomachinery useful to compress a working fluid such as, but not limited to, air, and deliver the working fluid to the diffuser which is configured to trade velocity of the working fluid for static pressure. The combustor 56 includes a fuel nozzle or other suitable device to dispense a fuel and mix with the working fluid prior to being combusted. Any variety of combustors can be used including annular, can annular, wave rotor, etc. The combustor 56 provides a flow stream to the turbine 58 which is used to expand the flow stream and provide power to drive the compressor, among other potential uses.

Although the gas turbine engine 50 is depicted as a single spool axial flow engine, other variations are also contemplated. For example, the engine 50 can include one or more centrifugal turbomachinery components, either in lieu of or as a supplement to the axial flow devices depicted. Additionally and/or alternatively the engine 50 can include any number of additional spools. In some forms the gas turbine engine 50 can be an adaptive and/or variable cycle engine. Furthermore, the gas turbine engine 50 can be used to provide power to an aircraft such as, but not limited to, an advanced tactical fighter.

As used herein, the term "aircraft" includes, but is not limited to, helicopters, airplanes, unmanned space vehicles, fixed wing vehicles, variable wing vehicles, rotary wing vehicles, unmanned combat aerial vehicles, tailless aircraft, hover crafts, and other airborne and/or extraterrestrial (spacecraft) vehicles such as dual stage to orbit vehicles including an air breathing first stage. Further, the present disclosures are contemplated for utilization in other applications that may not be coupled with an aircraft such as, for example, industrial applications, power generation, pumping sets, naval propulsion, weapon systems, security systems, perimeter defense/security systems, and the like known to one of ordinary skill in the art.

Figure 2:
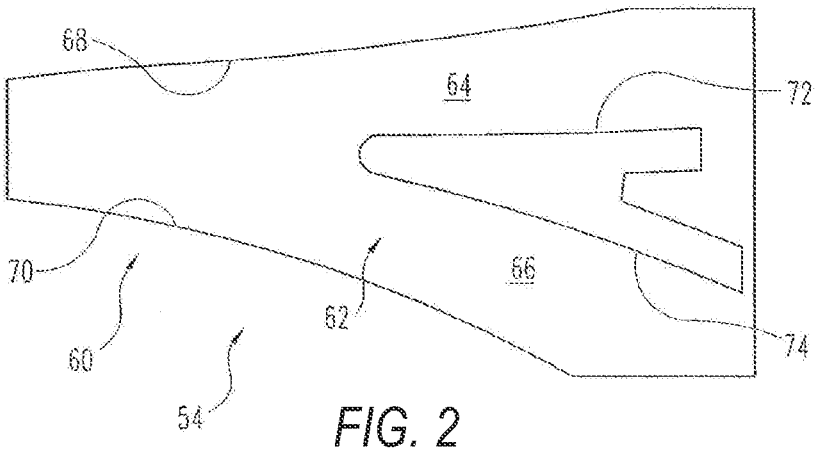
FIG. 2 depicts an embodiment of a diffuser.
Figure 3:
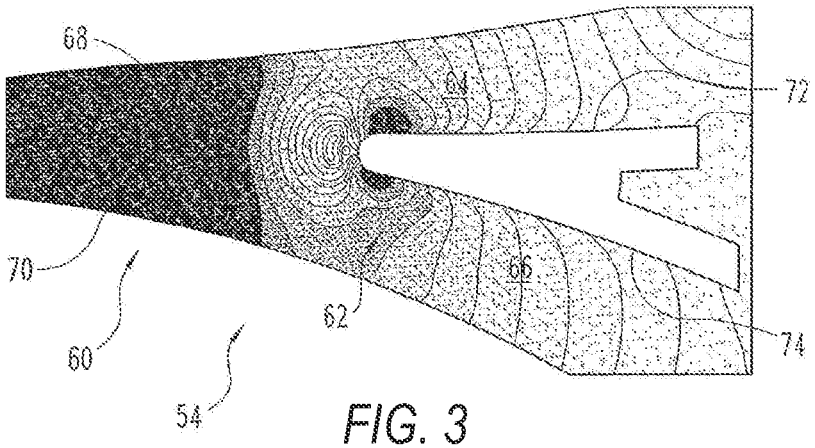
FIG. 3 depicts an embodiment of a diffuser.

Turning now to FIGS. 2 and 3, one embodiment of a diffuser 54 is depicted which includes an upstream passage 60, splitter 62, outer passage 64, and inner passage 66. As will be appreciated, working fluid enters an opening on the upstream side of the diffuser 54 and exits a downstream side. The length, height, area, etc of the passages 60, 64, and 66 can be determined using a variety of approaches and can vary from application to application, some of which are discussed further below. The upstream passage 60 includes an outer wall 68 and an inner wall 70 that can be oriented relative to each other to form a pre-diffuser in which the working fluid supplied by the compressor 52 is diffused. The outer wall 68 and inner wall 70 can diverge from each other at any variety of angles, a divergence which can remain constant or vary over the length of the upstream passage 60. Furthermore, the upstream passage 60 can be configured in various embodiments to assume any variety of area ratios as may be appropriate, desired, etc. for any given application. Additional characteristics of embodiments of the upstream passage 60 are discussed further below in regard to FIG. 5.

The outer passage 64 is formed downstream of a leading portion of the splitter 62. One side of the outer passage 64 is formed from the outer wall 68 shared with the upstream passage 60, and the other side of the outer passage 64 is formed by outer splitter wall 72. In one non-limiting embodiment, the outer passage 64 includes a downstream cross sectional area larger than an upstream cross sectional area such that a diffusion of the working fluid occurs prior to delivery to the combustor 56. To set forth just one non-limiting example, the outer wall 68 and the outer splitter wall 72 can diverge relative to each other to provide for an overall increase in cross sectional area. One or both of the walls 68 and 72 of the outer passage 64 can additionally and/or alternatively be turned to redirect the working fluid supplied by the compressor 52. In additional and/or alternative embodiments, the outer passage 64 can be turned in the aggregate in a radially outward direction to increase a cross sectional area by virtue of an increase in the annular space occupied by the outer passage 64.

The inner passage 66 is formed downstream of a leading portion of the splitter 62. One side of the inner passage 66 is formed from the inner wall 70 shared with the upstream passage 60, and the other side of the outer passage 64 is formed by inner splitter wall 74. In one non-limiting embodiment the inner passage 66 includes a downstream cross sectional area larger than an upstream cross sectional area such that a diffusion of the working fluid occurs prior to delivery to the combustor 56. To set forth just one non-limiting example, the inner wall 70 and the inner splitter wall 74 can diverge relative to each other to provide for an overall increase in cross sectional area. One or more of the walls 70 and 74 of the inner passage 66 can additionally and/or alternatively be turned to redirect the working fluid supplied by the compressor 52. In additional and/or alternative embodiments, the inner passage 66 can be turned in the aggregate in a radially inward direction which, though it can decrease a cross sectional area by virtue of a smaller annular space claim, the decrease can be offset by the relative orientation of the inner splitter wall 74 and inner wall 70.

Working fluid that flows through the upstream passage 60 encounters the splitter 62 and is split so that a portion flows through the outer passage 64 and a portion flows through the inner passage 66. The splitter 62 of the illustrated embodiment includes a blunt forebody in contrast to prior art forebodies that include sharp leading edges. Designers of gas turbine engine splitters have traditionally avoided use of blunt shapes in part due to a desire to create diffusion throughout the entirety of the diffuser where a blunt shape in contrast works against the diffusion for a portion of the diffuser by forming a local pressure disturbance region. As discovered in the instant application and discussed further below, a blunt forebody and its pressure affecting characteristics can be used to reset a boundary layer on an opposing wall. The term "blunt" will therefore be understood as being differentiated from many diffuser splitters that use sharp edges to demarcate the upper branch from the lower branch. Such a blunt shape is capable of radiating a static pressure bow wave as working fluid encounters the splitter 62 and as is shown in FIG. 3, discussed below. The creation of a static pressure effect from the presence of the blunt forebody is used to influence the boundary layer on the walls 68 and 70 and can decrease the boundary layers to provide additional degrees of freedom with respect to diffuser length, height, and area ratios. The blunt shape of the forebody can be located well aft of the entrance to the diffuser, and in some forms is roughly set back from the entrance approximately ⅓ to ½ the length of the diffuser.

The blunt shape provided by the instant application can be useful for purposes of engine wear and deterioration. Splitters having sharp leading edges can be useful if split lines are known and unchanging, but when various turbomachinery components experience wear and deterioration, the appropriate split line can change over time. The blunt shape can also be useful for fast transient engine events, such as a sudden surge in demanded power which can result in transient thermal conditions. For example, the blunt shape is more closely matched in terms of thermal transient response with other similar thermal mass components such as a strut that couples various portions of the diffuser. Sharper leading edges have a much faster thermal transient response than a thicker strut, thus leading in some applications to low cycle fatigue issues. The blunt shape can also make the diffuser more robust to variations in compressor performance and manufacturing tolerances such as those that might be common when manufacturing the diffuser through a casting operation.

As discussed above one or more features of the diffuser 54 can be used to turn the flow as it progresses from the compressor 52 to the combustor 56. In one form turning the flow assists in reducing dump losses as the flow encounters downstream combustor related components such as a cowl of the combustor.

Any variety of techniques can be used to form a diffuser 54. In one non-limiting embodiment the diffuser is made through an investment casting process to form an integral component. The diffuser 54 can include struts used to structurally couple one portion of the diffuser 54 with another. In some forms, the diffuser 54 can be non-integral such as when the diffuser 54 is composed of separate parts that are later fastened, bonded, etc., together to form a diffuser unit. In still other embodiments the diffuser 54 can be manufactured through free-form fabrication.

The outer passage 64 and inner passage 66 can be arranged to balance the flow between each other. The performance of a diffuser is sometimes limited by its poorest performing passage, such as a diffuser having one passage with a dynamic pressure significantly lower than another passage(s). Also, if a diffuser flow split is significantly mismatched with demand flows of the passages then loses will occur as flow redistributes as a result of the mismatched demand. To assist in balancing the flows between branches, the area ratio of the passages can be set as a function of properties of the diffuser and/or properties of the other passage(s). As set forth in the derivation below, an area ratio of the outer passage 64 can be set as a function of a chosen area ratio of the inner passage, a ratio of dynamic pressure for the two passages, and an anticipated/estimated/predicted/etc diffusion effectiveness, such as that can be determined based on L/H ratio to Area Ratio (AR) described in one form below in FIG. 5. The equations can be rearranged, if desired, to be find an area ratio of the inner passage 66 expressed as an analogous function of the other variables. As a first step in deriving a balanced flow, the coefficient of pressures of the outer and inner passages are expressed as follows:

$$Cpo = \frac{Pso2 - Pso1}{Pto1 - Pso1} = \eta o(1 - 1/ARo^2) \tag{1}$$

$$Cpi = \frac{Psi2 - Psi1}{Pti1 - Psi1} = \eta i(1 - 1/ARi^2) \tag{2}$$

where "o" represents the outer passage and "i" represents the inner passage. Next, set the static pressure at the inlet and outlet of the inner and outer passages equal to one another and define dynamic pressure:

$$\text{Pso 1=Psi 1} \tag{3}$$

$$\text{Pso 2=Psi 2} \tag{4}$$

$$Pt-Ps=Q \tag{5}$$

Setting the coefficient of pressures equal to one another and rearranging the equation solves for area ratio of the outer passage, as seen below in equation (8). As one considers the streamlines feeding the inner and outer passage the Q values $Q_i$ and $Q_o$ may not be equal.

$$\frac{Psi2 - Psi1}{Pso2 - Pso1} = 1 = \frac{Qin\eta i(1 - 1/ARi^2)}{Qo\eta o(1 - 1/ARo^2)} \tag{6}$$

$$(1 - 1/ARo^2) = \frac{Qin\eta i(1 - 1/ARi^2)}{Qo\eta o} \tag{7}$$

$$ARo = \left[\frac{1}{\left[1 - \frac{Qin\eta i}{Qo\eta o}(1 - 1/ARi^2)\right]}\right]^{1/2} \tag{8}$$

The balance of the passages as described above can be used in any of the embodiments of the diffuser 54 as described herein.

The diffuser 54 can include any number of passages, including any number of passages greater than those depicted in the illustrated embodiment. Alternatively and/or additionally, the diffuser 54 can include any number of splitters whether or not the additional splitters fall within the description of the splitter 62 described herein as having a blunt forebody. In some non-limiting embodiments a diffuser 54 can be a tripass diffuser with splitters having one or more characteristics of the blunt forebody. In other variations a tripass diffuser can include a splitter having one or more characteristics of a blunt forebody as described herein and another splitter with little to no characteristics as those described herein. The same variations in numbers and characteristics are possible for diffusers having additional splitters and passages.

Figure 4:
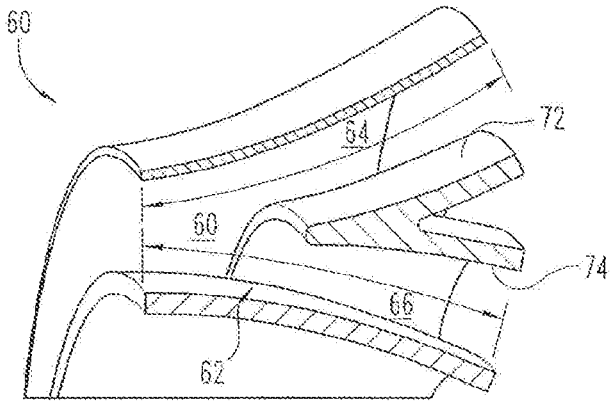
FIG. 4 depicts an embodiment of a diffuser.

FIG. 4 depicts an embodiment of a diffuser 54 including a splitter 62 having a combination of area ratios, in conjunction with a blunt forebody, that allows for relatively good pressure recovery in a relatively short length. The area ratio of the first portion of the diffuser 54 is 1.4 and the area ratio of the second portion is 1.44. In some embodiments of the diffuser 54, can have an area ratio of 2 by having two diffusers who's area ratio is the square root of 2 in series. In this case, the overall length cold be 4.828*H instead of 8*H as would be required for an area ratio of 2 in a diffuser without a restarted boundary layer. A note here: an area ratio of 1.414 is achieved in an L/H of 2, but an L/H of 4.828 is required and not 4 because the "second" diffuser in the series includes an increased duct height of 1.414.

Figure 5:
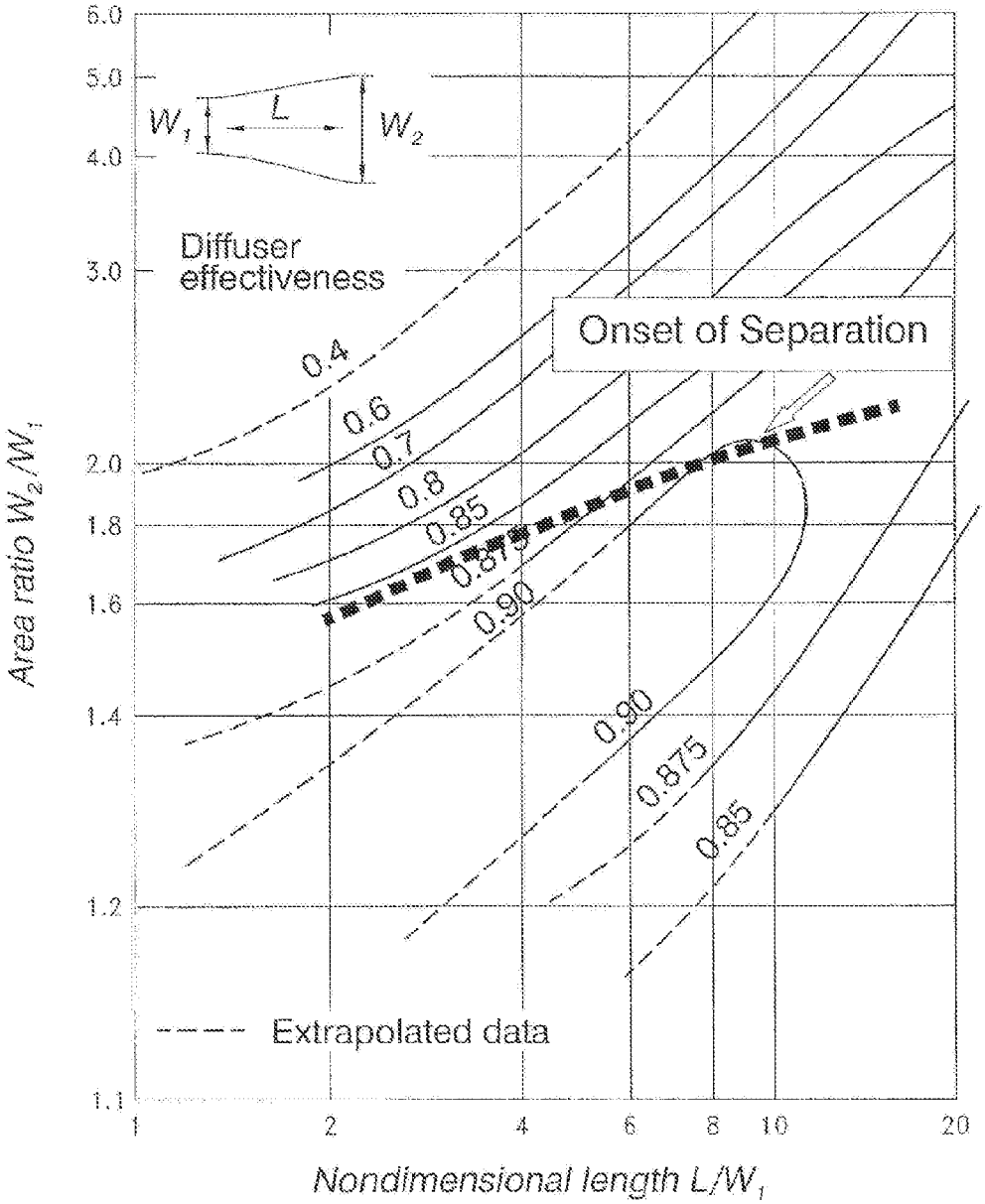
FIG. 5 depicts a chart showing diffuser characteristics.

FIG. 5 depicts one example of a chart useful in setting diffuser passage geometry. Shown in the chart is diffuser effectiveness as a function of area ratio and nondimensional length. A line that represents the onset of separation is also depicted in the chart. A designer has great flexibility in determining the any of the diffuser passage geometry using this or another similar chart. In the context of the re-started boundary layer made possible by the splitter blunt forebody discussed above, the properties, geometries, and characteristics of the upstream passage 60 can be determined up to or approaching onset of separation, and because the boundary layer is re-started, either or both of the outer passage 64 and inner passage 66 can also be determined up to or approaching an onset of separation. In this way the diffuser can be made much shorter, and lighter, than other splitters that use sharp and/or non-blunt splitter forebodies. Lastly, it will be appreciated that the chart depicted in FIG. 5 is only one example of characteristics useful in charting and predicting an onset of separation of a given diffuser geometry.

Figure 6:
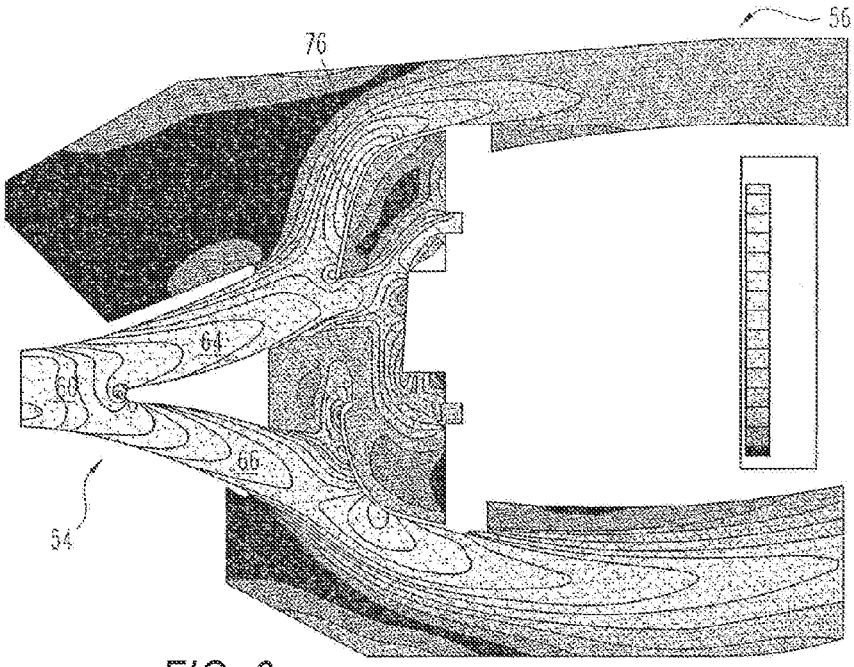
FIG. 6 depicts an embodiment of a diffuser and combustor.

FIG. 6 depicts one embodiment of a diffuser 54 that is arranged relative to a combustor 56 and in which a combustor cowl 76 is used to further split a flow that is passed from the compressor 52 through the outer passage 64. In some prior arrangements the diffuser passages are arranged to deliver a flow to the combustor 56 in locations which result in little to no further splitting of the flow. For example, in a three passage diffuser the air can be delivered to separate demand legs, one to a location between inner liner and outer liner, another to a location between the outer liner and the case, and a third to a location between the inner liner and the case. In the illustrated embodiment the diffuser includes two passage, one of which provides a feed to a location between the inner liner and the case, and another leg that provides feed to a combustor cowl that splits the flow into a portion directed to a location between the outer liner and the case and another location between the inner and outer liner.

Figure 7:
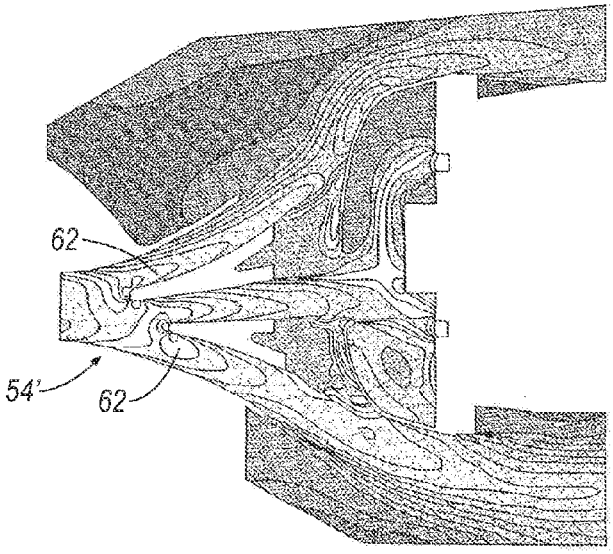
FIG. 7 depicts an embodiment of a diffuser and combustor.

FIG. 7 depicts yet another embodiment of a tri-pass diffuser 54' having blunt forebody shapes on each of the two splitters 62. Any variety of other combinations are contemplated.

Figure 8:
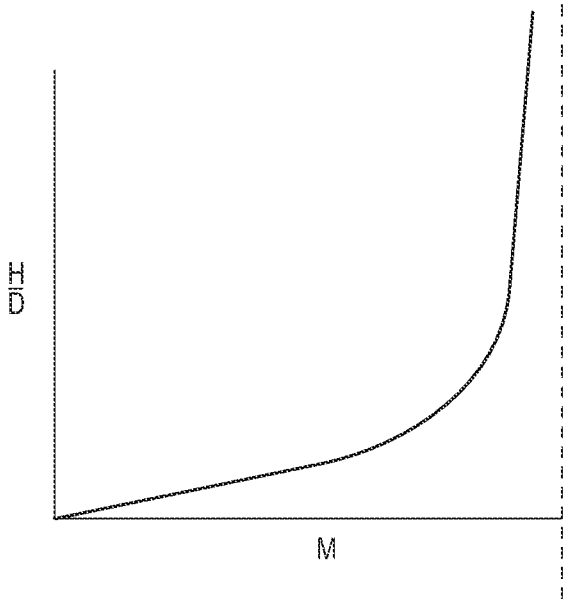
FIG. 8 depicts a relationship between H/D and Mach number.

FIG. 8 depicts graph showing the relationship between the splitter initial diameter (D) the height of the duct (H) and Mach number, where the relationship is expressed as:

$$(M^2 - 1)\left(\frac{H}{D}\right) = K \tag{9}$$

At a Mach number of 1, H/D is infinite and at a Mach number of 0, H/D>0. In the practical range of interest, which is some applications is (0.15-0.25) with a semi-circular leading edge, the value for H/D is expected to vary from about 6-8.

Figure 9:
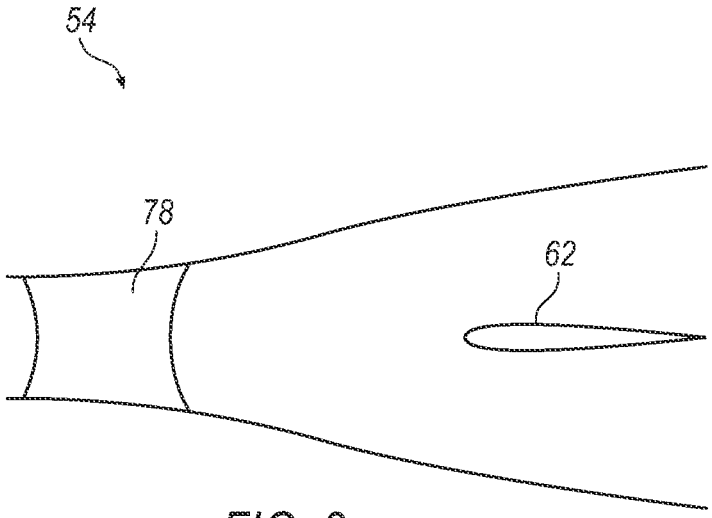
FIG. 9 depicts an inlet to a diffuser having a leant vane.

In yet another embodiment to those described above, FIG. 9 illustrates a multi-passage diffuser 54 with airfoil splitter 62. The embodiment depicted in FIG. 9 includes an inlet having a lean vane 78, or in other words a vane that includes lean. Any amount of lean and distribution of lean along the span is contemplated. Additionally, any number of vanes with lean can be distributed around the annulus. This provides a Q profile that is more or less even. Thus, the split line in the diffuser is very near the 50% span line (in the illustrated case it was at the 55% span line). At that span the Q was the same above and below, and thus the inner and outer passages could be expanded to the same. Being near the 50% span allows both passages to have roughly the same value for H and thus, the achieved the same area ratio and roughly the same length. The splitter is wedge-shaped. This allows the diffuser passages to be designed with a greater emphasis on the recovery of that passage rather than the downstream demand from the combustor and/or cowl. The airflow splitter also minimizes losses from high Q region in the middle of the flow field rather than a wedge-shaped splitter. This allows also for an air blast fuel nozzle to be located in line with the diffuser as is practiced in some applications. This allows for maximum head at the fuel nozzle feed.

In one aspect the present application provides a gas turbine engine working fluid apparatus comprising a multi-passage diffuser structured to be disposed between a compressor and a combustor of a gas turbine engine, the multi-passage diffuser having a first passage oriented to diffuse a first stream of working fluid traversing the first passage, a splitter disposed at a downstream portion of the first passage to partition the first stream into a second stream located radially outward of a third stream, wherein a leading edge of the splitter is formed as a blunt shape sufficient to produce a static pressure bow wave that radiates to a radially outer wall of the radially outward second passage and radiates to a radially inner wall of the radially inward third passage, the blunt shape causing an interaction with the flow stream in the region of the splitter to decrease a boundary layer formed on the radially inner wall and the radially outer wall.

A feature of the present application provides wherein a geometry of the first passage approaches an onset of separation limit, the blunt shape is configured to restart the boundary layer, and a geometry of the second passage also approaches an onset of separation.

Another feature of the present application provides wherein an overall length of the multi-passage diffuser is decreased relative to a multi-passage diffuser that lacks a re-started boundary layer.

Yet another feature of the present application provides wherein the multi-passage diffuser is a single cast article, and an area ratio of the radially inward third passage is a function of: an area ratio of the radially outward second passage, a ratio of dynamic pressures between the radially inward third passage and radially outward second passage, and a ratio of effectiveness of the radially inward third passage and radially outward second passage.

Still another feature of the present application provides wherein the multi-passage diffuser includes a second splitter.

Yet still another feature of the present application provides wherein the second splitter includes a leading edge having a blunt shape sufficient to produce a second splitter static pressure bow wave that radiates to opposing walls between which the leading edge is disposed.

Still yet another feature of the present application provides wherein the splitter is configured to turn a flow of the diffuser to reduce dump losses around a combustor cowl.

Another aspect of the present application provides an apparatus comprising a gas turbine engine diffuser having diverging inner and outer walls useful to decrease a velocity and raise a static pressure of a fluid stream, the diffuser also including a splitter having a bluff forebody disposed intermediate a downstream end and upstream end of the diffuser to create a restriction and thereby promote a pressure field across the diffuser between the inner and outer walls sufficient to re-start a boundary layer.

Yet another feature of the present application provides wherein the diffuser includes an overall length, wherein the splitter is structured to permit an an upstream portion of the gas turbine engine diffuser located forward of the bluff forebody to have an upstream area ratio that approaches a separation limit, and a downstream portion of the gas turbine engine diffuser located aft of the bluff forebody to have a downstream area ratio that also approaches a separation limit, the upstream area ratio and downstream area ratio combined to provide an overall area ratio greater than permitted for a diffuser of the same overall length without the splitter bluff forebody.

Still another feature of the present application provides wherein the bluff forebody bifurcates the fluid stream into a first stream and a second stream, and wherein the diffuser is disposed within a gas turbine engine having a compressor, combustor, and turbine, and wherein the bluff forebody is structured to reduce a size of respective boundary layers formed on the diverging inner and outer walls during operation of the gas turbine engine.

Yet still another feature of the present application provides wherein the first stream is radially outward of the second stream, and wherein the bluff forebody is substantially aft of the upstream end of the diffuser.

Still yet another feature of the present application provides wherein the first stream traverses a first passage downstream of the bluff forebody, the second stream traverses a second passage downstream of the bluff forebody, and an area ratio of the first passage is set according to the function $$AR_f = \left( \frac{1}{\left[ 1 - \frac{Q_s \eta_s}{Q_f \eta_f} (1 - 1/AR_s^2) \right]} \right)^{1/2}$$

where $AR_f$ is area ratio of the first passage, $AR_s$ is area ratio of the second passage, $$\frac{Q_s \eta_s}{Q_f \eta_f}$$

is a ratio of dynamic pressures for the two passages and an anticipated diffusion effectiveness based on geometry of the passages.

A further feature of the present application provides wherein a portion of the diffuser upstream of the bluff forebody is a pre-diffuser, and a portion of the diffuser downstream of the bluff forebody is a pair of passages split by the forebody, and which further includes a gas turbine engine within which is disposed the gas turbine engine diffuser.

A still further feature of the present application provides wherein the diffuser includes an area ratio of about 2 with an L/H of about 3.

Yet another aspect of the present application provides an apparatus comprising a gas turbine engine having a compressor structured to compress a working fluid, a diffusion duct leading to a combustor having a fuel opening for dispensing a fuel to be mixed with the working fluid, and a turbine oriented to receive a flow from the combustor, and means for re-setting a boundary layer in the diffusion duct as the working fluid is expanded to trade velocity for static pressure.

Still yet another aspect of the present application provides a method comprising receiving a working fluid in to a gas turbine engine compressor, compressing the working fluid through operation of rotating turbomachinery to raise a total pressure of the working fluid, diffusing the working fluid in a multi-passage diffuser to trade dynamic pressure for static pressure, encountering an area restriction in the multi-passage diffuser, lowering a static pressure of the working fluid in the vicinity of the area restriction, and as a result of the lowering, reducing a thickness of a boundary layer formed on opposing walls of the multi-passage diffuser.

A feature of the present application provides wherein the encountering includes splitting the working fluid into a first branch and a second branch.

Another feature of the present application provides wherein the diffusing the working fluid includes diffusing the working fluid in a prediffuser of the multi-passage diffuser upstream of the area restriction.

Still another feature of the present application further includes balancing flows of working fluid in the first branch and second branch.

Yet still another feature of the present application further includes approaching a first separation limit in a prediffuser and a second separation limit in a branch of the multi-passage diffuser downstream of the area restriction.

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosures are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the disclosure, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus for a working fluid of a gas turbine engine, the apparatus comprising:

a multi-passage diffuser disposed between a compressor and a combustor of a gas turbine engine, the multi-passage diffuser having:

a first passage oriented to diffuse a first stream of working fluid traversing the first passage, and a splitter disposed at a downstream portion of the first passage to partition the first stream into a second passage having a second stream located radially outward of a third passage having a third stream, wherein a leading end of the splitter is formed as a blunt shape that is sufficient to produce a static pressure bow wave that radiates to a radially outer wall of the second passage and radiates to a radially inner wall of the third passage, thereby causing an interaction with a flow stream in a region of the splitter to form a pressure field across the diffuser, between the radially inner wall and the radially outer wall, that is sufficient to re-start a boundary layer along the radially inner wall and the radially outer wall; and a combustor cowl of the combustor configured to further split at least one of the second and third streams from the multi-passage diffuser, thereby delivering the working fluid to a first location between an inner liner and an outer liner, a second location between the outer liner and a case, and a third location between the inner liner and the case.

2. The apparatus of claim 1, wherein a geometry of the first passage approaches an onset of separation limit, the blunt shape is configured to restart the boundary layer, and a geometry of the second passage also approaches an onset of separation.

3. The apparatus of claim 1, wherein an overall length-to-height ratio of the multi-passage diffuser is 4.8.

4. The apparatus of claim 1, wherein the multi-passage diffuser is a single cast article, and wherein an area ratio of the third passage is a function of:

an area ratio of the second passage, a ratio of dynamic pressures between the third passage and second passage, and a ratio of effectiveness of the third passage and second passage.

5. The apparatus of claim 1, further comprising a second splitter.

6. The apparatus of claim 5, wherein the second splitter includes a leading end having a blunt shape sufficient to produce a second splitter static pressure bow wave that radiates to opposing walls between which the leading end is disposed.

7. The apparatus of claim 1, wherein the splitter is configured to turn a flow of the diffuser to reduce dump losses of the combustor cowl.

8. An apparatus comprising:

a diffuser of a gas turbine engine, the diffuser having diverging inner and outer walls useful to decrease a velocity and raise a static pressure of a fluid stream, the diffuser also including a splitter having a bluff forebody disposed intermediate a downstream end and upstream end of the diffuser to create a restriction and thereby promote a pressure field across the diffuser, between the inner and outer walls, that is sufficient to re-start a boundary layer along each of the inner and outer walls.

9. The apparatus of claim 8, wherein the diffuser includes an overall length, wherein the splitter is structured to permit an upstream portion of the diffuser located forward of the bluff forebody to have an upstream area ratio that approaches a separation limit, and a downstream portion of the diffuser located aft of the bluff forebody to have a downstream area ratio that also approaches a separation limit, the upstream area ratio and downstream area ratio combined to provide an overall area ratio greater than permitted for a diffuser of the same overall length without the splitter bluff forebody.

10. The apparatus of claim 8, wherein the bluff forebody bifurcates the fluid stream into a first stream and a second stream, and wherein the diffuser is disposed within a gas turbine engine having a compressor, combustor, and turbine, and wherein the bluff forebody is structured to reduce a size of respective boundary layers formed on the diverging inner and outer walls during operation of the gas turbine engine.

11. The apparatus of claim 10, wherein the first stream is radially outward of the second stream, and wherein the bluff forebody is aft of the upstream end of the diffuser.

12. The apparatus of claim 8, wherein the fluid stream includes a first stream and a second stream, the first stream traverses a first passage downstream of the bluff forebody, the second stream traverses a second passage downstream of the bluff forebody, and an area ratio of the first passage is set according to the function $$AR_f = \left(\frac{1}{\left[1 - \frac{Q_s\eta_s}{Q_f\eta_f}(1 - 1/AR_s^2)\right]}\right)^{1/2}$$

where $AR_f$ is area ratio of the first passage, $AR_s$ is area ratio of the second passage, $$\frac{Q_s\eta_s}{Q_f\eta_f}$$

is a ratio of dynamic pressures for the first and second passages and an anticipated diffusion effectiveness based on geometry of the first and second passages.

13. The apparatus of claim 8, wherein a portion of the diffuser upstream of the bluff forebody is a pre-diffuser, and a portion of the diffuser downstream of the bluff forebody is a pair of passages split by the bluff forebody, and which further includes a gas turbine engine within which is disposed the diffuser.

14. The apparatus of claim 13, wherein the diffuser includes an area ratio of 2 with an L/H of 3.

15. The apparatus of claim 8, further comprising a compressor structured to compress a working fluid, a diffusion duct leading to a combustor having a fuel opening for dispensing a fuel to be mixed with the working fluid, and a turbine oriented to receive a flow from the combustor.

16. A method comprising:

receiving a working fluid in a gas turbine engine compressor;

compressing the working fluid through operation of rotating turbomachinery to raise a total pressure of the working fluid;

diffusing the working fluid in a multi-passage diffuser to trade dynamic pressure for a static pressure of the working fluid;

encountering an area restriction in the multi-passage diffuser;

causing an interaction with a flow stream at a blunt shape to form a pressure field across the multi-passage diffuser, between opposing walls of the multi-passage diffuser, that is sufficient to re-start a boundary layer along the opposing walls;

lowering the static pressure of the working fluid in the vicinity of the area restriction; and as a result of the lowering of the static pressure, reducing a thickness of the boundary layer formed on the opposing walls of the multi-passage diffuser.

17. The method of claim 16, wherein the encountering includes splitting the working fluid into a first branch and a second branch.

18. The method of claim 17, which further includes balancing flows of working fluid in the first branch and second branch.

19. The method of claim 16, wherein the diffusing the working fluid includes diffusing the working fluid in a prediffuser of the multi-passage diffuser upstream of the area restriction.

20. The method of claim 16, which further includes approaching a first separation limit in a prediffuser of the multi-passage diffuser upstream of the area restriction and a second separation limit in a branch of the multi-passage diffuser downstream of the area restriction.

* * * * *